United States Patent [19]

Sweet et al.

[11] Patent Number: 4,527,315

[45] Date of Patent: Jul. 9, 1985

[54] JEWELRY CLASP

[76] Inventors: Richard H. Sweet, Four Crossman Ave., Attleboro, Mass. 02703; Thomas J. Baker, 36 Cedar Hill Rd., Dover, Mass. 02030; Erick E. Stickel, Three Sundale Rd., Cranston, R.I. 02920; Emile Gauthier, 113 Lucy Dr., South Attleboro, Mass. 02703

[21] Appl. No.: 519,916

[22] Filed: Aug. 3, 1983

[51] Int. Cl.[3] ..... B65H 57/16

[52] U.S. Cl. ..... 24/615; 24/618

[58] Field of Search ..... 24/609, 611, 614, 615, 24/616, 618, 625, 627

[56] References Cited

U.S. PATENT DOCUMENTS

| | | | |
|---|---|---|---|
| 711,826 | 10/1902 | Collins | 24/618 |
| 924,104 | 6/1909 | Powell | 24/615 |
| 1,094,947 | 4/1914 | Strauss et al. | 24/609 |
| 1,396,887 | 11/1921 | Schroetter | 24/618 X |
| 1,807,293 | 5/1931 | Keller | 24/618 X |
| 2,368,543 | 1/1945 | Hattenrath | 24/618 X |
| 2,885,925 | 5/1959 | Vezzi | 24/625 X |
| 3,225,406 | 12/1965 | Levy | 24/618 X |

*Primary Examiner*—William E. Lyddane
*Assistant Examiner*—Peter A. Aschenbrenner
*Attorney, Agent, or Firm*—Barlow & Barlow, Ltd.

[57] ABSTRACT

This invention relates to a jewelry clasp which has a generally tubular body into which is received a catch. The catch consists of a doubled-over strip of spring metal which has central longitudinal portions thereof struck outwardly to provide a bearing surface so that the catch can be more readily inserted into the tubular body. To retain the two parts together, the tubular body has at an open end thereof, an inturned lip while one of the legs of the catch is provided with retaining means in the form of notches that engage the lip on the body.

1 Claim, 10 Drawing Figures

JEWELRY CLASP

BACKGROUND OF THE INVENTION

One of the common forms of jewelry clasps that are in use with necklaces are what is known in the trade as a box clasp, due primarily to the fact that it has a box-like body into which a spring member may be inserted. It is common for clasps of this nature to have at the end wall of the box-like casing, an aperture which is usually elongated so that it will receive a spring-like member. An example of this type of construction is seen in the Schick specification, U.S. Pat. No. 1,813,963, and in British Specification No. 130,222.

A difficulty in using this type of clasp is experienced by many individuals, for they find it difficult to place the catch in through the opening as this is being done, for the most part, "blind"—that is to say, while the clasp is in the back of one's neck. It is desirable, therefore, to have a clasp that is more readily inserted and released from a body so that ease of insertion and withdrawal is enhanced.

SUMMARY OF THE INVENTION

There is provided herein a clasp particularly for necklaces in which a tubular body, closed at one end, is provided, along with a catch. The catch comprises essentially a doubled-over strip of spring metal that tends to spring apart. The tubular body is provided with an inturned lip at its open end so that when the catch legs are inserted within the body and spring apart, a portion of the legs will engage on the inner side of the inturned lip and prevent withdrawal of the catch.

DETAILED DESCRIPTION OF THE PREFERRED EMBODIMENTS

Figure 1:
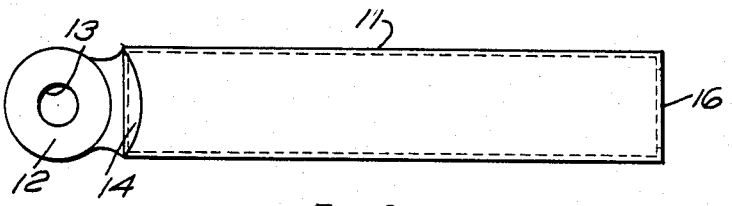
FIG. 1 is a central longitudinal view of the body of our clasp.
Figure 2:
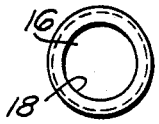
FIG. 2 is an end view of the body.
Figure 3:
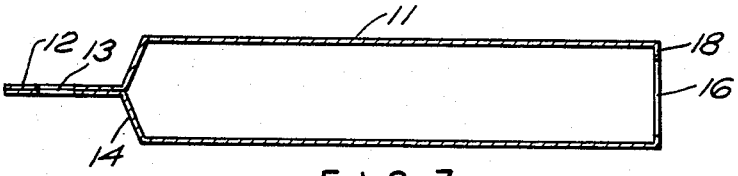
FIG. 3 is a sectional view thereof.

Referring now to the drawings, our improved clasp comprises a tubular body 11 which is cylindrical in shape and which may be formed in a variety of ways so that an attachment cap 12 with an aperture 13 is provided. The tubular body 11 is closed as at the end 14 while the other end 16 is open. The end 16 is defined by an inwardly turned lip 18 which extends radially inward about the opening 16.

Figure 7:
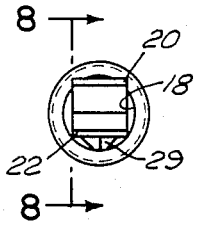
FIG. 7 is an end view thereof.

Within the tubular body a spring catch is designed to fit and cooperate therewith. The catch comprises a strip of spring metal bent over on itself so as to form essentially two legs 20 and 22 that are joined together as to 24, the leg 22 being slightly extended beyond leg 20 so as to provide a space for an aperture 26 to which an end of a necklace or the like might be attached. The legs 20 and 22 will be of a dimension smaller than the inner diameter of the open end 16 as defined by the inner diameter of the lip 18. To assist in the insertion of the catch within the tubular body, each of the legs has a portion thereof struck outwardly as seen at 28 and 29, which portion in cross section is more or less triangular in shape. This struck-out portion provides a bearing surface that will permit the catch as it is inserted within the tubular body to readily slide along the end of the inwardly-turned lips 18 (see FIG. 7). In addition, the portion at 24 where the two legs are bent over each other acts as a guide to assist the user to insert the catch within the tubular body.

Figure 8:
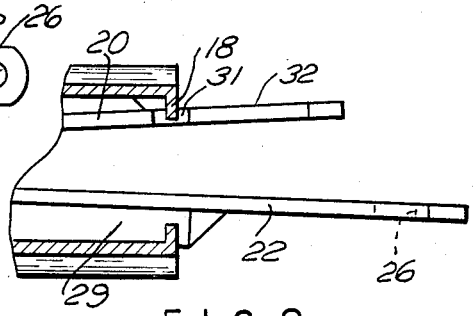
FIG. 8 is an enlarged partial sectional view showing the engagement of the catch in the body.
Figure 6:
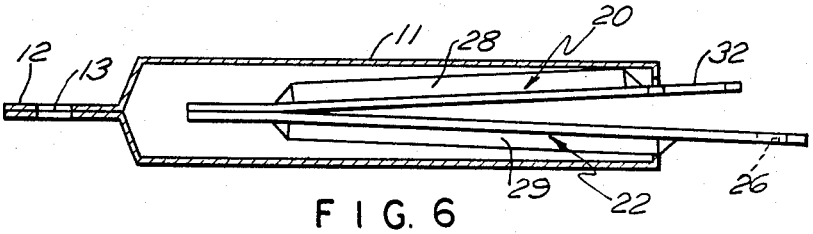
FIG. 6 is a longitudinal sectional view of the catch within the body.

So that positive engagement can be had, notches 30, 31 are cut into the leg 20 sufficiently inward from the terminus of the leg 20 so that a finger grip area as at 32 may be provided. The notches, when the catch is fully inserted within the tubular body, will engage the lip 18 (see FIG. 8); and when removal is desired, it is merely necessary to press against the area 32, squeezing the same toward the leg 22; and in this fashion, the catch may be readily withdrawn from the body.

Figure 4:
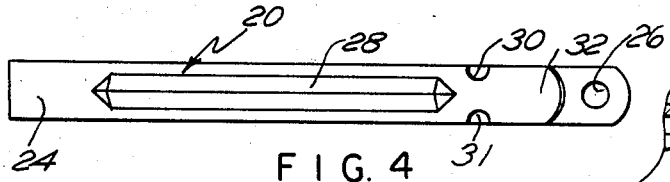
FIG. 4 is a top view of the catch.
Figure 5:
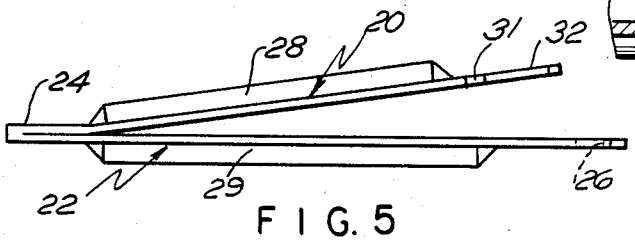
FIG. 5 is a side elevational view thereof.
Figure 9:
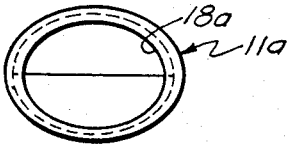
FIGS. 9 and 10 are end views of modified body cross-sectional shapes.
Figure 10:
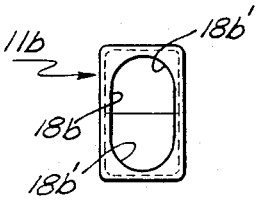

Referring now to FIGS. 9 and 10, alternate forms of the tubular body are illustrated, there being shown an oval tubular body 11*a* in FIG. 9 and a rectangular tubular body 11*b* in FIG. 10. In each of these situations, the catch as seen in FIGS. 4 and 5 is utilized. In each of these cases there is an inturned lip 18*a*, 18*b* respectively; and in the case of the showing of FIG. 10, the radiused corner, as for example at 18*b*′, is sufficiently large so that the notch 30 and 31 may engage the same when the legs 20 and 22 spring apart.

We claim:

1. A clasp having a generally tubular body closed at one end and open at the opposite end, said opposite end having a circumferential inturned lip, a catch having a doubled-over strip of spring metal to form a pair of legs that tend to spring apart, each leg having a central longitudinal portion struck outwardly therefrom to provide a bearing surface against the inturned lip when the catch is inserted and withdrawn from the tubular body, one leg of the catch being provided with notches in the side wall thereof adjacent the terminus of the leg, the notches adapted to engage the inturned lip when the catch is fully inserted into the body.

* * * * *